US008857420B2

(12) United States Patent
Grace

(10) Patent No.: US 8,857,420 B2
(45) Date of Patent: Oct. 14, 2014

(54) CROSSBOW WITH ARROW RETAINER

(75) Inventor: Johnny Grace, Broadway, VA (US)

(73) Assignee: Archery America, L.L.C., DeQuincy, LA (US)

( * ) Notice: Subject to any disclaimer, the term of this patent is extended or adjusted under 35 U.S.C. 154(b) by 251 days.

(21) Appl. No.: 13/278,737

(22) Filed: Oct. 21, 2011

(65) Prior Publication Data

US 2013/0098343 A1 Apr. 25, 2013

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)
USPC ..... 124/25; 124/86

(58) Field of Classification Search
CPC ..... F41B 5/12; F41B 5/143; F41B 5/1469
USPC ..... 124/25, 86
See application file for complete search history.

(56) References Cited

U.S. PATENT DOCUMENTS

| | | | | | |
|---|---|---|---|---|---|
| 3,788,299 | A * | 1/1974 | Mathews | 124/35.1 |
| 4,688,539 | A * | 8/1987 | Lawrence | 124/27 |
| 4,716,880 | A * | 1/1988 | Adkins | 124/25 |
| 5,085,200 | A * | 2/1992 | Horton-Corcoran et al. | 124/25 |
| 5,598,829 | A * | 2/1997 | Bednar | 124/25 |
| 5,649,520 | A * | 7/1997 | Bednar | 124/25 |
| 5,884,614 | A * | 3/1999 | Darlington et al. | 124/25 |
| 6,425,386 | B1 * | 7/2002 | Adkins | 124/31 |
| 6,736,123 | B1 * | 5/2004 | Summers et al. | 124/25 |
| 6,802,304 | B1 * | 10/2004 | Chang | 124/25 |
| 7,455,059 | B2 * | 11/2008 | Shaffer | 124/25 |
| 7,588,022 | B2 * | 9/2009 | Chang | 124/25 |
| 7,770,567 | B1 * | 8/2010 | Yehle | 124/25 |
| 7,814,894 | B2 * | 10/2010 | Giroux | 124/25 |
| 8,091,540 | B2 * | 1/2012 | Matasic et al. | 124/31 |
| 2008/0060629 | A1 * | 3/2008 | Chang | 124/25 |
| 2008/0127956 | A1 * | 6/2008 | Bednar et al. | 124/25 |
| 2008/0202487 | A1 * | 8/2008 | Maleski et al. | 124/25 |
| 2009/0114200 | A1 * | 5/2009 | Giroux | 124/25 |
| 2010/0000503 | A1 * | 1/2010 | Bednar et al. | 124/25 |

* cited by examiner

*Primary Examiner* — Gene Kim
*Assistant Examiner* — Alexander Niconovich
(74) *Attorney, Agent, or Firm* — Schultz & Associates, P.C.

(57) ABSTRACT

An archery crossbow having an arrow retainer provided by a yieldable member located within a bore located on a sight guide or a trigger housing of the bow and including an arrow contact portion that extends outwardly of the bore to contact the arrow.

10 Claims, 7 Drawing Sheets

CROSSBOW WITH ARROW RETAINER

FIELD

The present disclosure relates to the field of crossbows. More particularly, the disclosure relates to structures for retaining arrows from movement until the arrow is shot.

BACKGROUND

The majority of crossbows use a device to hold the arrow or bolt until it is shot. Such devices are needed for a number of reasons. One reason is to keep the arrow from sliding forward such as when the archer aims down from a tree stand. Another is to attempt to hold the arrow in the same place on the bow to aid in consistency and accuracy.

Up to this point, the manner of holding the arrow in place has been to use an extended finger made of a metal material. The finger is exteriorly mounted to extend out away from the front of the trigger housing or sight bridge from one inch to several inches at an angle to contact the arrow.

These fingers-type arrow holders have various disadvantages, such as excessive noise or vibration, causing or contributing to arrow fletching wear, degrading accuracy, and not effectively holding the arrow in place. Accordingly, improvement is desired. Furthermore, their exterior location renders them subject to damage and misalignment.

The present disclosure relates to an improved arrow retainer configuration for crossbows that avoids disadvantages of prior devices.

SUMMARY

The above and other needs are met, in one aspect, by an archery crossbow for shooting an arrow having a length axis having fins.

The crossbow includes a bowstring, limbs, a trigger, and a trigger housing having a bore in which is located an arrow retainer. The arrow retainer includes a yieldable member being substantially located within the bore and including an arrow contact portion that extends outwardly of the bore to contact the arrow.

The crossbow is operated by drawing the bowstring to be tensioned by the limbs the tensioned bowstring being retained within the trigger housing and the arrow being positioned with a nock thereof against the bowstring. The trigger is operated to release the bowstring and shoot the arrow and the arrow retainer functions to provide pressure against the arrow.

In another aspect of the disclosure, a crossbow is provided which includes a bowstring, limbs, a trigger, a trigger housing, and a sight bridge located above the trigger housing having a bore in which is located an arrow retainer. The arrow retainer includes a yieldable member being substantially located within the bore and including an arrow contact portion that extends outwardly of the bore to contact the arrow.

Arrow retainers according to the disclosure advantageously avoid problems associated with conventional arrow retainers, such as exposure to damage, misalignment, and the like.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
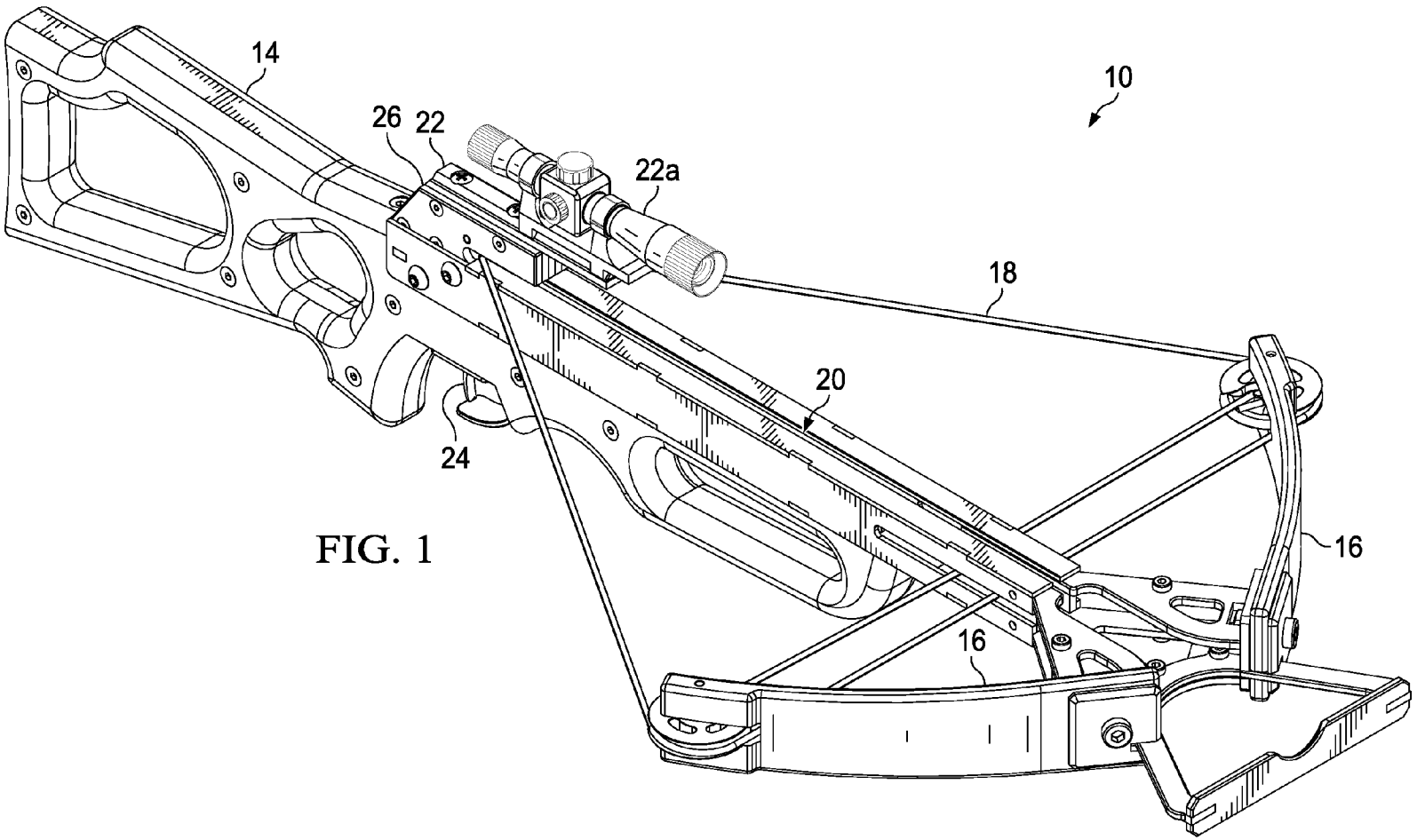
FIG. 1 is a perspective view of a crossbow having an arrow retainer according to one embodiment of the disclosure.

The disclosure relates to an arrow retainer for crossbows. In this regard, with initial reference to FIGS. 1-2, the disclosure relates in one embodiment to a crossbow 10 configured to include an arrow retainer 12 located so as to substantially vertically bear against a bolt or arrow A having a nock N and fins or fletching F.

The crossbow 10 includes a stock 14, limbs 16, a bowstring 18, a flight groove 20, a sight bridge 22 having a scope 22*a* mounted thereon, a trigger 24, and associated trigger assembly within a trigger housing 26. The crossbow 10 is operated by drawing the bowstring 18 to be tensioned by the limbs 16, the tensioned bowstring 18 being retained by the trigger assembly. The arrow A is then positioned with the nock N against the bowstring 18 and one of the fins F within the flight groove 20. The trigger 24 is then operated to release the bowstring 18 and shoot the arrow A. The arrow retainer 12 functions to provide pressure against the arrow A to retain it against the flight groove while avoiding many of the shortcomings of prior devices.

Figure 2:
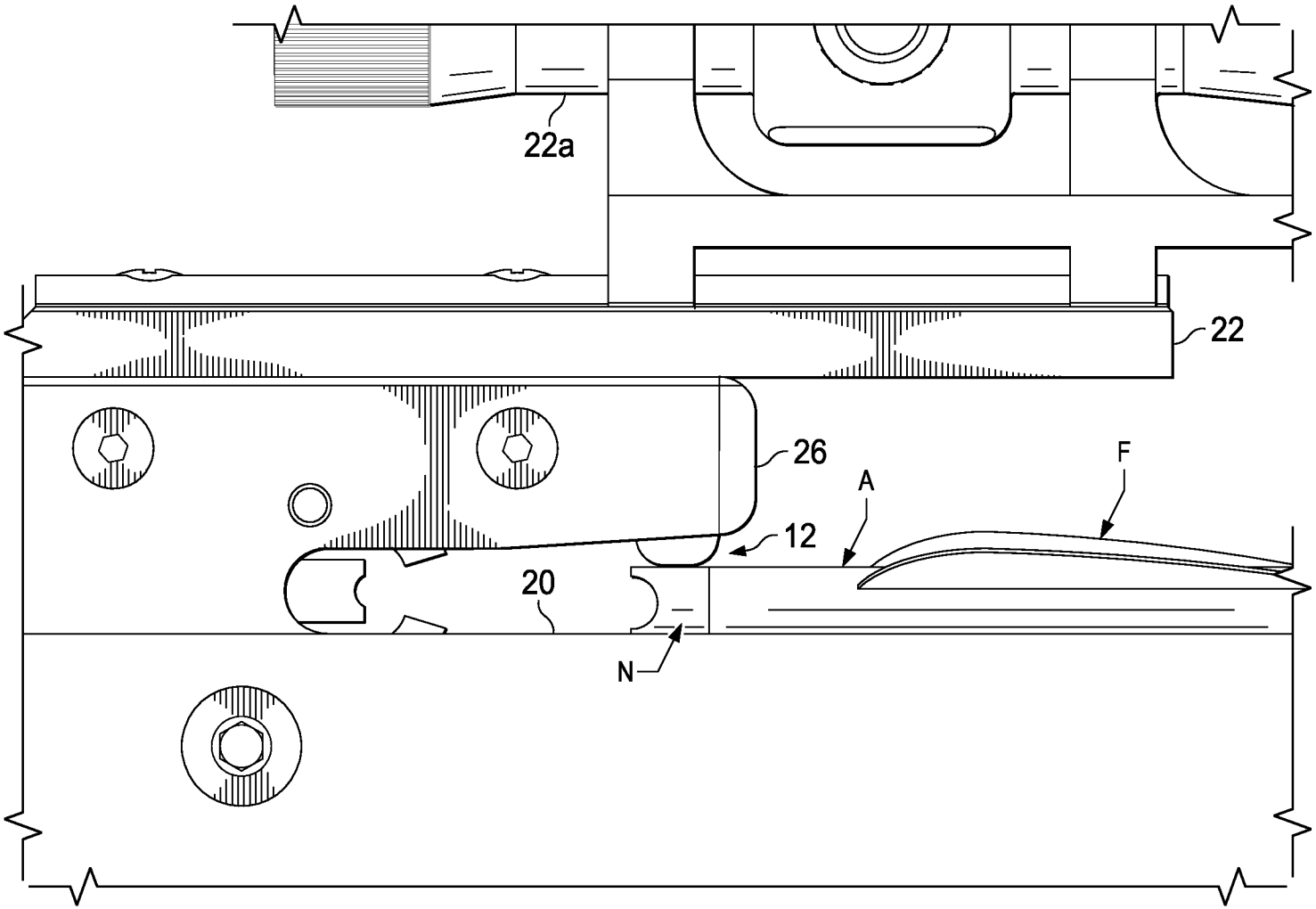
FIG. 2 is a close-up perspective view showing the arrow retainer of the crossbow of FIG. 1.
Figure 3:
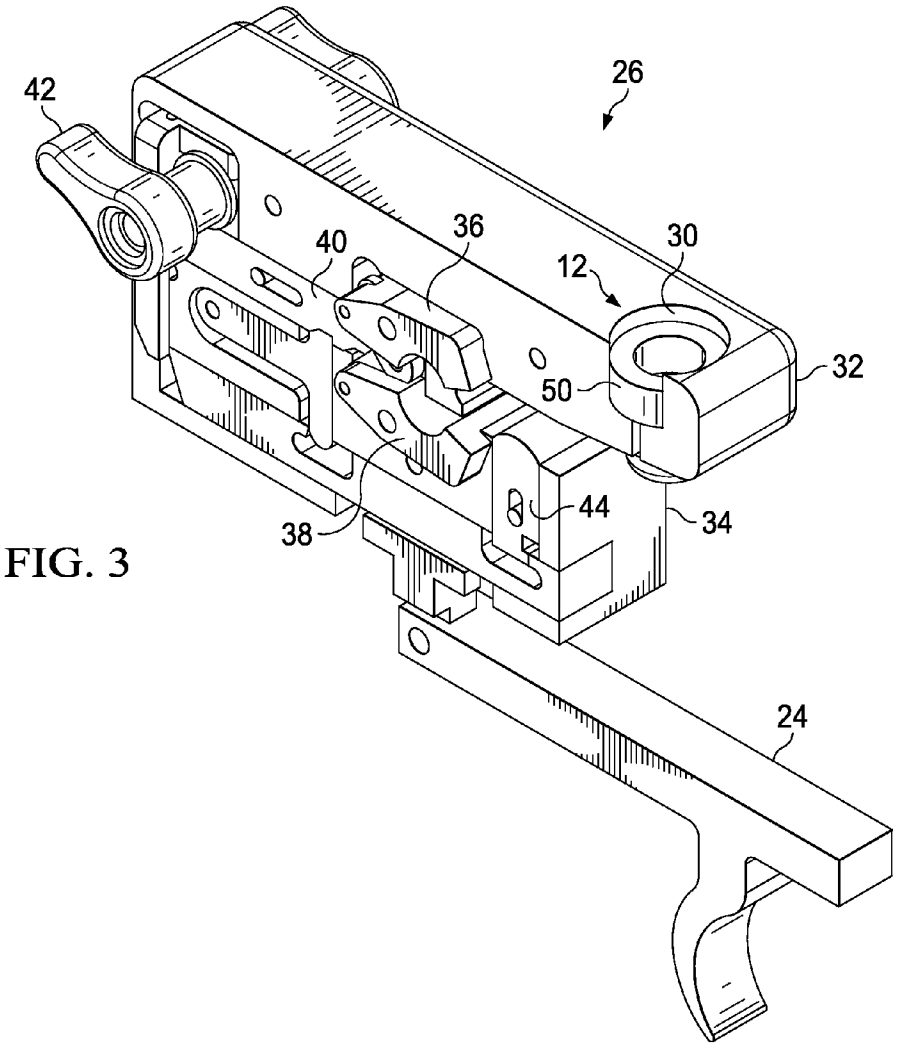
FIGS. 3 and 4 show a trigger housing configured to include an arrow retainer according to the disclosure.

With additional reference to FIGS. 2 and 3, the arrow retainer 12 is located within a bore 30 defined on the trigger housing 26. In one embodiment, the trigger housing 26 includes an upper housing portion 32 and a lower housing portion 34, between which is located an upper jaw 36 and a lower jaw 38 linked to a jaw urging member 40. The jaw urging member 40 is operably connected to the trigger 24. The upper jaw 36 and the lower jaw 38 close together to retain the bowstring 18 when the crossbow 10 is drawn. By operating the trigger 24, a user selectively operates the jaw urging member 40 to move the upper jaw 36 and the lower jaw 38 apart to release the bowstring 18 and shoot the arrow A. The trigger housing 26 may also include a safety operated by lever 42 and a dry fire arrester 44 operably associated with the trigger 24.

As shown in FIGS. 2 and 3, in one embodiment, the bore 30 is a bifurcated through bore located on an extension 46 of the upper housing portion 32 that extends distally past a receiver 48 defined by the facing sides 32*a* and 34*a*, respectively, of the spaced apart portions of the upper housing 32 and the lower housing 34 immediately proximate the upper jaw 36 and the lower jaw 38. The bore 30 includes a larger diameter bore portion 30*a* that opens at the uppermost surface of the extension 46 and a smaller diameter bore portion 30*b* that opens at the lowermost surface of the extension 46 so as to be facing toward the arrow A when it is positioned in the trigger housing 26. In one embodiment, the large diameter bore has a diameter of about 0.5 inches and the small diameter bore has a diameter of about 0.3 inches, although other suitable dimensions may be utilized for the bore. The larger diameter bore portion 30 will desirably be covered by the sight bridge 22 installed so as to overlie the bore 30.

A resilient plug, such as a rubber plug 50, is configured to be fit within the bore 30 and includes a larger diameter portion 50*a* that fits within the bore portion 30*a* and a smaller diameter portion 50*b* that fits within the bore portion 30*b* protrudes outwardly therefrom to define an arrow contact surface 52. The arrow contact surface 52 is located and configured to lightly contact the arrow A. In a preferred embodiment, the arrow contact surface may have a diameter of about 0.05 to about 0.3 inches. The yieldable force supplied by the rubber plug 50 via the arrow contact surface 52 advantageously bears the arrow A towards the flight groove 20 without detrimentally affecting the flight characteristics of the arrow. In this regard, it will be noted that the plug 50 and the contact surface 52 preferably project in a direction substantially perpendicular to the length axis of the arrow A being shot by the crossbow 10. The rubber is yieldable and provides a pressure against the arrow. In certain embodiments, the plug may be made of other resilient materials, such as suitable polymeric or other resilient, synthetic materials.

Figure 4:
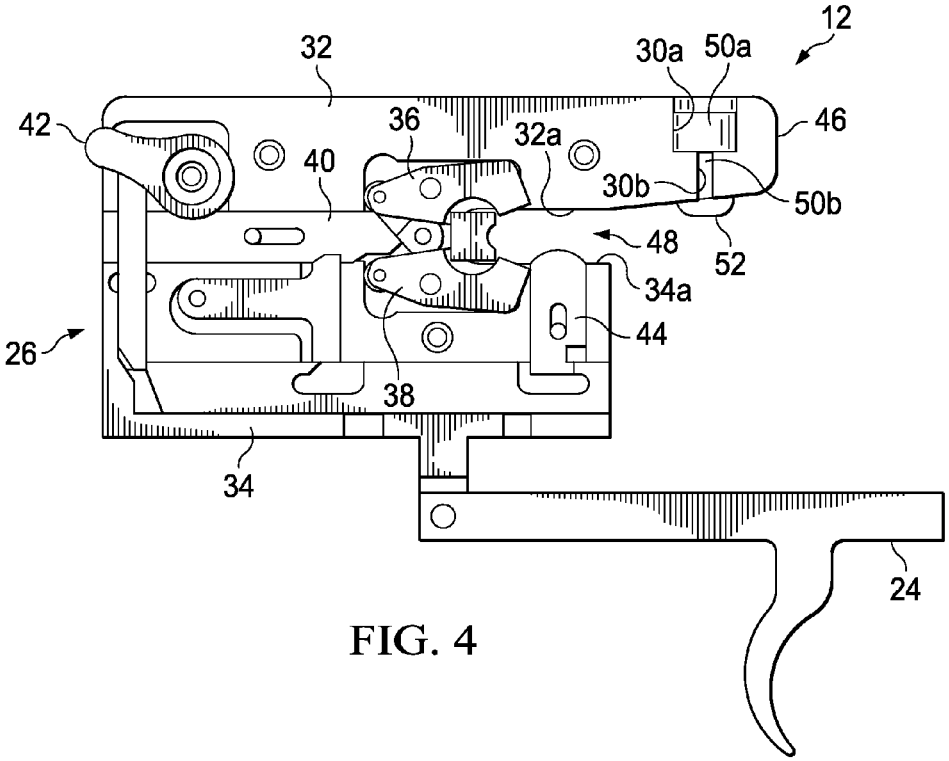

In a preferred embodiment, the bore 30 and plug 50 are substantially cylindrical. However, in other preferred embodiments, the bore 30 and plug 50 could have rectangular or triangular cross sections or other appropriate shaped cross section. Additionally, the different portions of the bore 30 and plug 50 shown in FIG. 4 have substantially uniform diameters, but could be tapered. Furthermore, in certain embodiments, the bore 30 and plug 50 may have not have portions with different cross sections along their length, but may rather have uniform cross section along their entire lengths. The arrow contact portion may have a dome, conical, blunt, or other appropriate shape for providing a point of contact against an arrow.

The location of the contact surface 52 is desirably selected so that the contact surface 52 engages the arrow A at a location on the surface of the arrow A that is substantially along the uppermost surface of the arrow A along the centerline of the arrow A and in-between adjacent ones of the fins F when the bowstring 18 is drawn and the arrow A is situated in the receiver with the nock N retained adjacent the jaws 36 and 38. Such location is advantageous to avoid wearing of the fins F, since the contact surface 52 is in-between the fins F and does not contact the fins F. Also, because of the structure of the retainer 12, and because the location of the contact surface 52 is fixed, protected by its location within the trigger housing 26, and not subject to loosening and moving side-to-side in the manner of an attached prior art finger device, the retainer 12 applies substantially uniform pressure to the arrow A that does not significantly change over time. The consistent operation also serves to cooperate well with the dry fire arrester 44. The retainer 12 has also been observed to not experience substantial vibration and operate substantially quieter than prior art devices.

Figure 5:
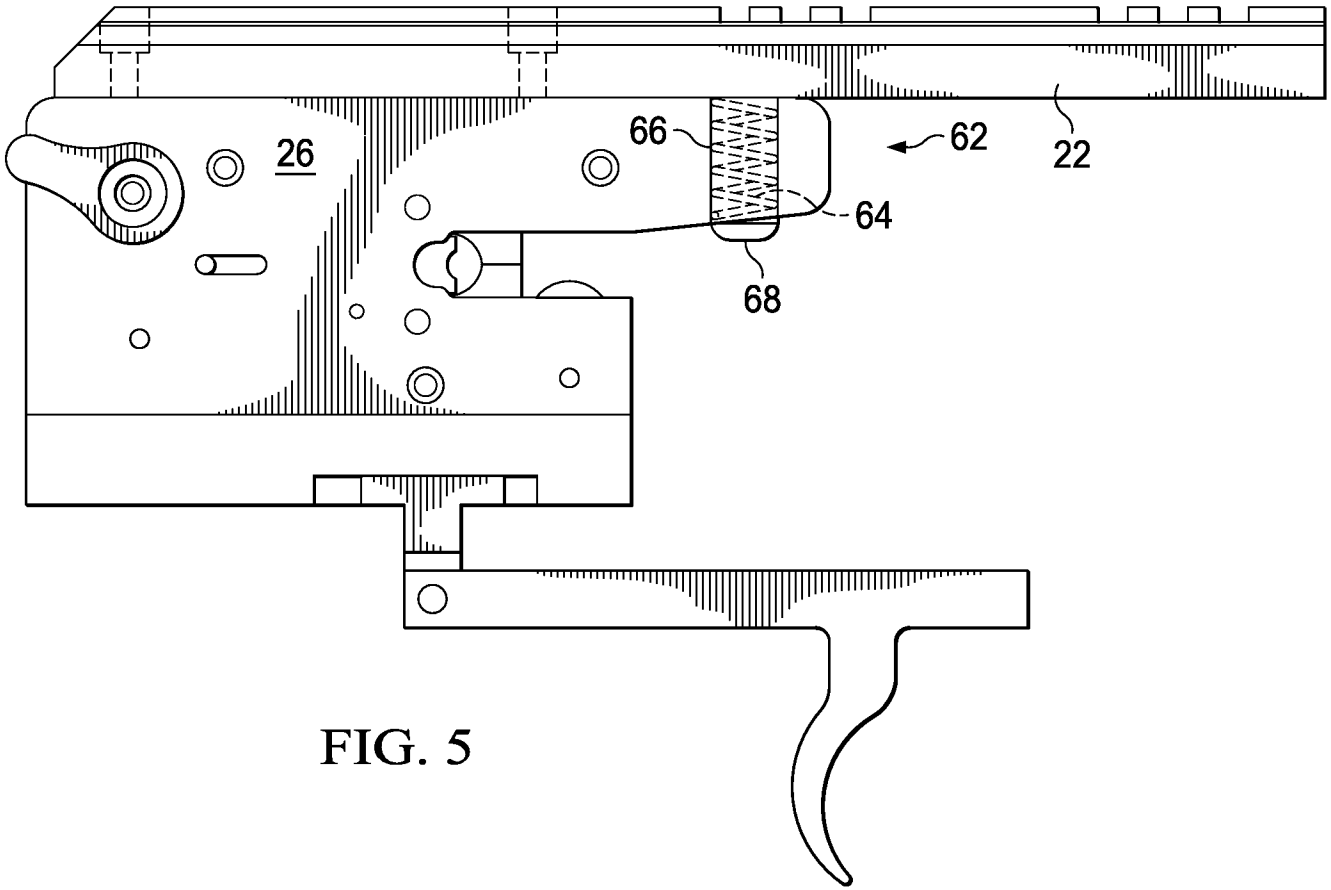
FIG. 5 shows an alternate embodiment having a sight bridge configured to include an arrow retainer according to the disclosure.

With reference to FIG. 5, there is shown an alternate embodiment of an arrow retainer 62. The retainer 62 is located in the same manner as the retainer 12, but may be formed from a hard plastic or metal material. The retainer is urged towards the arrow by a spring 64 located within a bore 66, with a portion of the retainer extending outwardly to provide an arrow contact surface 68. The yieldable force supplied by the spring 64 via the arrow contact surface 68 advantageously bears the arrow A towards the flight groove 20 without detrimentally affecting the flight characteristics of the arrow. As in the manner of the retainer 12, the location of the retainer 62 is advantageously protected from subjecting the retainer 62 from damage. That is, location of the retainer 62 is substantially within the trigger housing 26 between the upper housing portion 32 and a the lower housing portion 34, such that the retainer 62 is protected.

Figure 6:
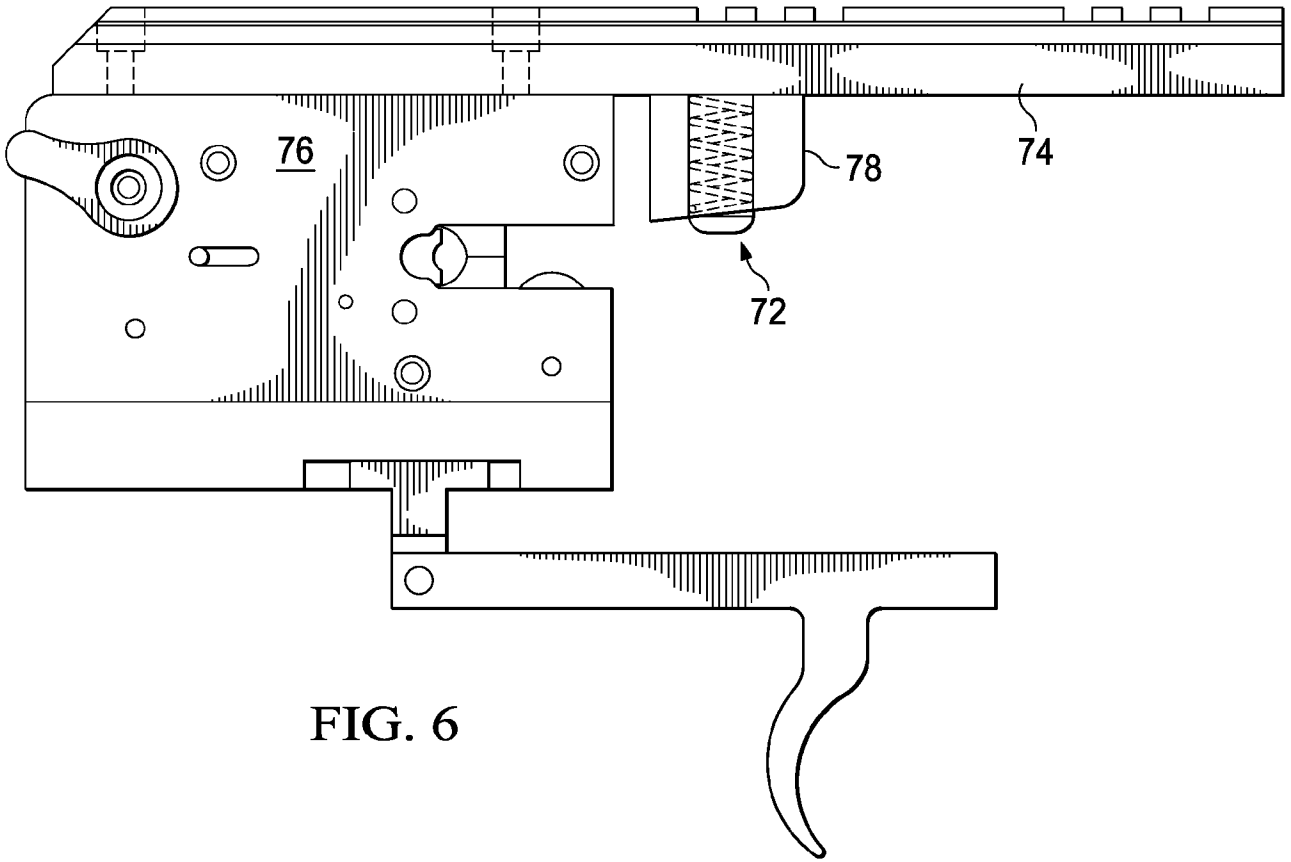
FIG. 6 shows an alternate embodiment of a trigger housing configured to include an arrow retainer according to the disclosure.

With reference to FIG. 6, there is shown an alternate embodiment of an arrow retainer 72. The retainer 72 is configured in the manner of the retainer 62 and is located in a position similar to the position of the retainer 12 and the retainer 62, except the retainer 72 extends from a sight bridge 74. In this regard, it will be noted that the previously described trigger housing 26 was configured to include the extension 46 for the purpose of providing structure for locating the retainer 12. In the embodiment of FIG. 6, there is shown a trigger housing 76 that is substantially identical to the trigger housing 26, except it does not include the extension 46. However, as will be noted, the sight bridge 74 is configured to include a downwardly extending projection 78. The projection 78 occupies substantially the same location as did the extension 46 of the trigger housing 26, and provides structure for locating the retainer 72. In this regard, it will be appreciated that the sight bridge 74 having the retainer 72 is well-suited for application as a retrofit on conventional crossbows to provide a retainer according to the disclosure.

Figure 7:
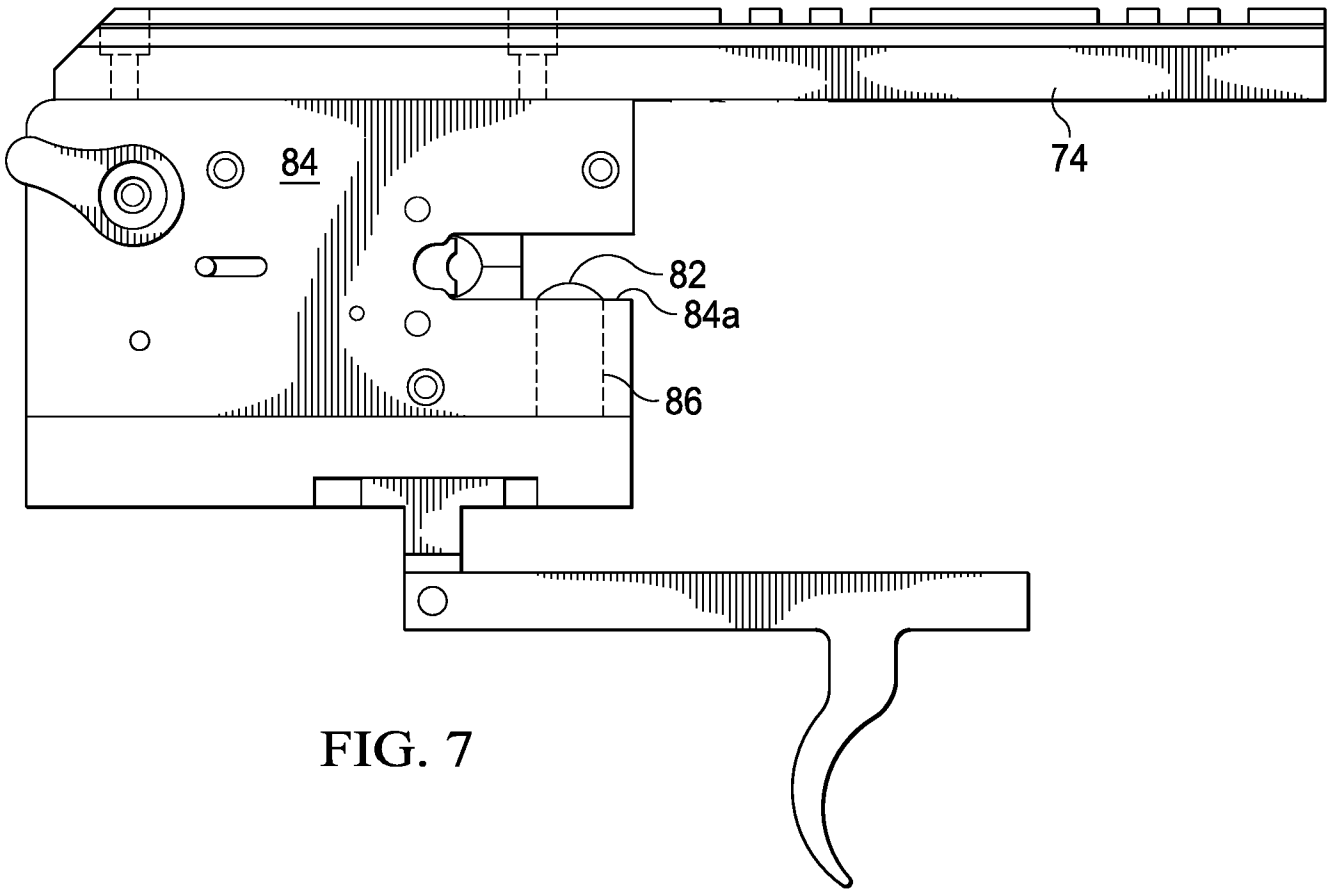
FIG. 7 shows another alternate embodiment of a trigger housing configured to include an arrow retainer according to the disclosure.

With reference to FIG. 7, there is shown an alternate embodiment of an arrow retainer 82. The retainer 82 is configured in the manner of the retainer 62 and the retainer 72, but is located to extend from a lower portion 84*a* of a trigger housing 84. In this regard, the trigger housing 84 does not utilize the dry fire arrester 44 as described for the trigger housing 26. Instead, a different dry fire mechanism may be utilized and the retainer 82 is located within a bore 86 provided at the site.

As will be appreciated, arrow retainers according to the disclosure are advantageously located in a protected, recessed location within the trigger housing or the sight guide, and project in a direction substantially perpendicular to the axis of the arrow A being shot by the crossbow 10. Only a small contact portion of the retainer extends outwardly to contact the arrow A. Thus, unlike conventional finger style retainers, retainers according to the disclosure are not located on an exterior portion of the crossbow and are substantially protected from damage.

Another advantage relates to the structure of the retainers characterized as having a yieldable retainer that is substantially enclosed within a bore that closely fits the portions of the retainer therein, and extends only slightly outwardly from the bore for contacting the arrow A. As will be appreciated, the bore which closely fits the portions of the retainer therein protects the retainer from damage and also substantially eliminates any misalignment or change in alignment of the retainer relative to the arrow. Thus, the retainers according to the disclosure are not subject to misalignment in the manner of conventional finger retainers. This advantageously avoids a detrimental effect on accuracy by having a consistent pressure and position of the retainer on the arrow. This structure also advantageously results in a substantial reduction in noise as compared to conventional retainers and the consistent pressure applied by the retainer facilitates its operation dry fire arresters.

Another advantage that may be achieved by the disclosed retainers is the ability to locate the retainer to contact the arrow at a central portion that avoids contact with the fins of the arrow. This is advantageous to avoid detrimental effects on accuracy caused by fin contact and wear of fins.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. An archery crossbow for shooting an arrow having a length axis having fins, the crossbow comprising: a bowstring, limbs, a trigger assembly including a trigger, and a trigger housing having a bore in which is located an arrow retainer positioned within the bore and moveable in a direction substantially perpendicular to the length axis, the bore further comprising a first bore portion and a second bore portion adjacent to and different in diameter than the first bore portion, the arrow retainer comprising a yieldable member being substantially located within the bore having a first member portion positioned in and retained by the first bore portion and an arrow contact portion positioned in the second bore portion and extends outwardly of the bore to contact the arrow, an urging member connected to the trigger;

a first jaw connected to the urging member and releasably engaged with the bowstring;

a second jaw connected to the urging member opposite the urging member and releasably engaged with the bowstring;

wherein the crossbow is operated by drawing the bowstring to be tensioned by the limbs, the tensioned bowstring being retained by the trigger assembly and the arrow being positioned with a nock thereof against the bowstring, wherein the trigger is operated to release the bowstring and shoot the arrow and the arrow retainer functions to provide pressure against the arrow.

2. The crossbow of claim 1, wherein the yieldable member comprises a resilient plug.

3. The crossbow of claim 2, wherein the resilient plug comprises a rubber plug.

4. An archery crossbow for shooting an arrow having a length axis having fins, the crossbow comprising: a bowstring, limbs, a trigger assembly including a trigger, a trigger housing, and a sight bridge located above the trigger housing, the sight bridge having a bore in which is located an arrow retainer positioned within the bore and moveable in a direction substantially perpendicular to the length axis, the arrow retainer comprising a yieldable member being substantially located within the bore having an arrow contact portion that extends outwardly of the bore to contact the arrow, wherein the crossbow is operated by drawing the bowstring to be tensioned by the limbs, the tensioned bowstring being retained by the trigger assembly and the arrow being positioned with a nock thereof against the bowstring, wherein the trigger is operated to release the bowstring and shoot the arrow and the arrow retainer functions to provide pressure against the arrow.

5. The crossbow of claim 4, wherein the retainer comprises a resilient plug.

6. The crossbow of claim 5, wherein the resilient plug comprises a rubber plug.

7. The crossbow of claim 4, wherein the retainer comprises a spring.

8. An archery crossbow for shooting an arrow having a length axis having fins, the crossbow comprising: a bowstring, limbs, a trigger assembly including a trigger, a trigger housing, a bifurcated bore formed in the trigger housing, further comprising a first bore portion having a first diameter and a second bore portion having a second diameter, adjacent the first bore portion, the first diameter different than the second diameter, a shoulder separating the first bore portion and the second bore portion and an arrow retainer comprising a yieldable member having a first member portion positioned in the first bore portion and retained by the shoulder and an arrow contact portion for contacting the arrow, positioned in the second bore portion, the arrow contact portion urged towards the arrow in a direction substantially perpendicular to the axis of the arrow by the yieldable member, an urging member connected to the trigger;

a first jaw connected to the urging member and releasably engaged with the bowstring;

a second jaw connected to the urging member opposite the urging member and releasably engaged with the bowstring;

wherein the crossbow is operated by drawing the bowstring to be tensioned by the limbs, the tensioned bowstring being retained by the trigger assembly and the arrow being positioned with a nock thereof against the bowstring, wherein the trigger is operated to release the bowstring and shoot the arrow and the arrow retainer functions to provide pressure against the arrow.

9. The crossbow of claim 8, wherein the retainer comprises a resilient plug.

10. The crossbow of claim 9, wherein the resilient plug comprises a rubber plug.

* * * * *